US006120343A

United States Patent [19]

Migliorati

[11] Patent Number: 6,120,343

[45] **Date of Patent: *Sep. 19, 2000**

[54] MECHANISM FOR MOVING THE LOWER LIMBS OF A TOY FIGURE

[76] Inventor: Sostene Migliorati, c/o Giochi Preziosi Lussemburgo S.A., 23, Rue Beaumont, L-1219 Luxembourg, Luxembourg

[ * ] Notice: This patent issued on a continued prosecution application filed under 37 CFR 1.53(d), and is subject to the twenty year patent term provisions of 35 U.S.C. 154(a)(2).

[21] Appl. No.: 09/301,415

[22] Filed: Apr. 28, 1999

[51] Int. Cl.[7] ..... A63H 7/00

[52] U.S. Cl. ..... 446/377; 446/317

[58] Field of Search ..... 496/268, 285, 496/293, 294, 312, 377, 380, 317

[56] References Cited

U.S. PATENT DOCUMENTS 985,746 2/1911 Lewis ..... 446/294
2,627,700 2/1953 Weiss ..... 446/312
2,763,095 9/1956 Stearns ..... 446/377
2,776,525 1/1957 Ford ..... 446/199
4,721,489 1/1988 Galoob ..... 446/23

*Primary Examiner*—Sam Rimell
*Attorney, Agent, or Firm*—Laff, Whitesel & Saret, Ltd.; Charles A. Laff

[57] ABSTRACT

In a mechanism for moving the lower limbs to enable a toy to walk in a manner similar to the way a human walks. A drive mechanism in the body of the toy imparts a pivoting movement to the limbs to make the toy walk. The movements make one limb to move 180° out of phase with the other limb. The toy counterbalances the reaction torque generated during the movement of the limb. A rod-shaped element slides freely in a recess housing within the body of the toy. A resilient helical spring acting on the rod-shaped element urges the limbs to move.

6 Claims, 8 Drawing Sheets

MECHANISM FOR MOVING THE LOWER LIMBS OF A TOY FIGURE

BACKGROUND OF THE INVENTION

1. Field of the Invention

The present invention relates to a mechanism for moving the lower limbs connected to the body of a toy figure to enable the toy figure to walk over a supporting surface in a similar manner to a human being, in which each of the limbs includes a thigh-shaped portion, a lower-leg-shaped portion connected to the adjacent end of the thigh-shaped portion by a knee joint, and a foot-shaped portion connected to the lower-leg-shaped portion by an ankle joint, and in which a drive means, housed in a compartment of the body of the toy figure, is connected to the thigh-shaped portion in order to impart thereto a pivoting movement in a vertical plane parallel to the direction in which the toy figure is made to walk, and a rectilinear translational movement in the direction of the longitudinal axis of the thigh-shaped portion between a lower dead-point position and an upper dead-point position and vice versa, the movements relating to one limb being out of phase by 180° with the homologous movements of the other limb and the toy figure having means for counterbalancing the reaction torque generated by the drive means during the movement of the thigh-shaped portion.

2. Description of the Released Art

Toy figures, particularly dolls of human or fantasy appearance, having limb-movement and walking mechanisms are known in the art.

Examples of these mechanisms are described in U.S. Pat. No. 2,641,964, WO-92/21416, EP-A-0743083, EP-A-0879625 and in J-A-63/163894.

However, the performance of known mechanisms is limited since the toy figures have simplified and rather stiff joints, producing regular walking movements very different from those of a human being.

Moreover, none of the known mechanisms mentioned above enables the toy figure to adopt positions in which the limbs are bent, for example, a sitting position with the limbs bent at a right angles to the torso, without causing damage or breakage such as to compromise the functionality of the mechanism.

SUMMARY OF THE INVENTION

The object of the present invention is therefore to provide a mechanism for moving the limbs of a toy figure, particularly a doll, which enables the toy figure to walk in a very similar manner to a human being and which, at the same time, enables the toy figure to adopt positions with bent legs, for example, a sitting position, without danger of compromising its functionality.

BRIEF DESCRIPTION OF THE DRAWINGS

The invention will now be described in greater detail with reference to a preferred embodiment thereof, illustrated by way of non-limiting example in the appended drawings, in which.

DETAILED DESCRIPTION OF THE INVENTION

Figure 1:
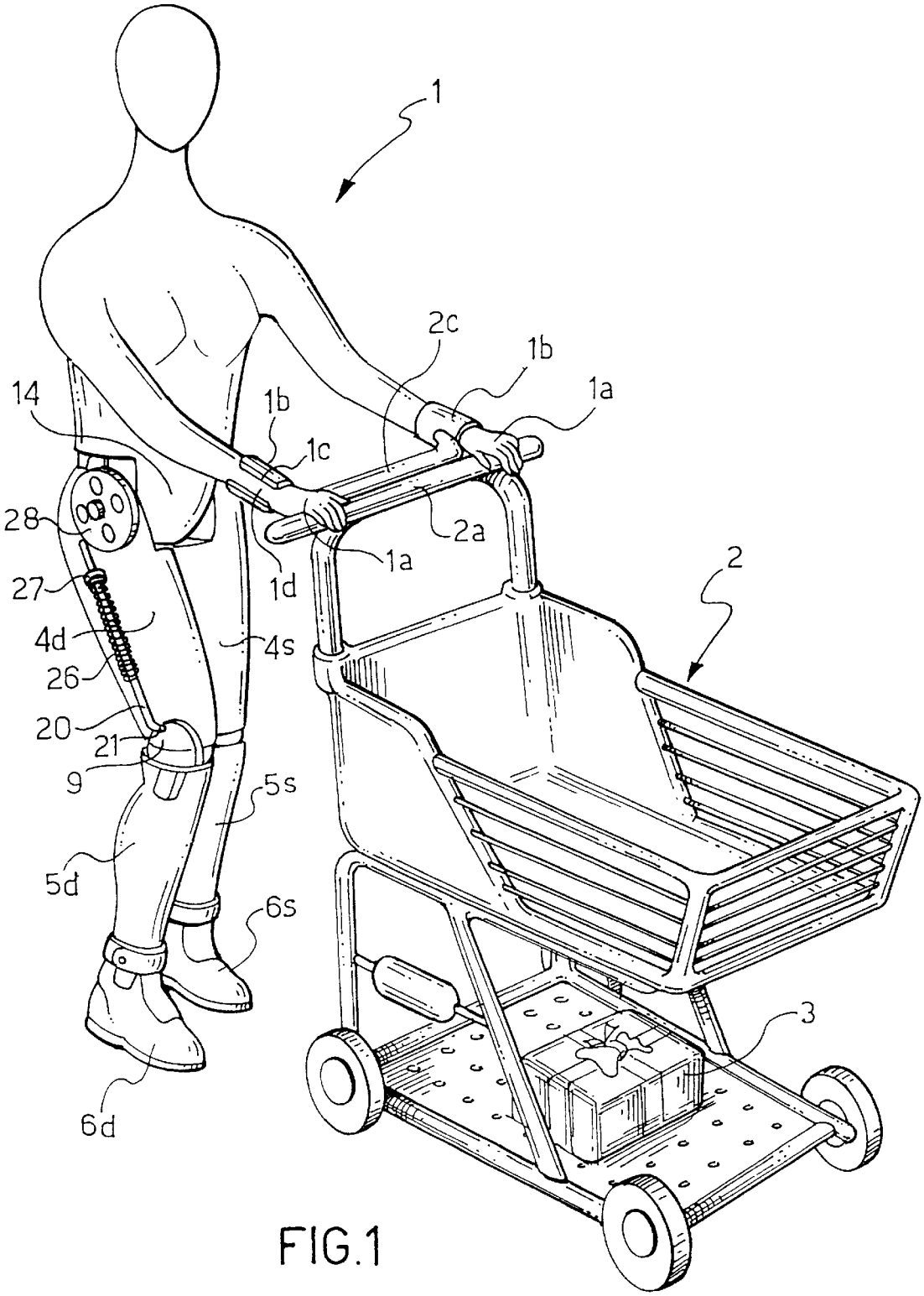
FIG. 1 is a schematic view of a toy figure in the form of a doll incorporating the mechanism of the invention.

With reference to the drawings, the toy figure which, in the preferred but not exclusive configuration, has the appearance of a doll, is indicated 1 in FIG. 1.

To enable the doll 1 to walk independently, it is preferably connected to an accessory such as, for example, a shopping trolley, indicated 2, having an suitable weight, in the form of a package 3, to produce a torque for balancing the reaction torque produced by the drive means which is provided for moving the legs and which is housed, in conventional manner, in a compartment in the doll's body.

As shown in FIG. 1, the hands 1*a* of the doll 1 are kept firmly fixed to the handle 2*a* of the shopping trolley 2 by means of connecting sleeves 1*b*.

Each connecting sleeve 1*b* is provided with a longitudinal cut 1*c* through which the wrist portion 1*d* of the upper limbs of the doll can be manually engaged and disengaged.

The sleeves 1*b* are fixed to the ends of a rod 2*c* which in turn is connected to the handle 2*a*.

Alternatively, in the absence of a supporting accessory, the doll 1 may be held by the user by gripping an upper limb with one hand.

Each of the legs of the doll 1 includes a thigh-shaped portion 4*d*, 4*s*, a lower-leg-shaped portion 5*d*, 5*s*, and a foot-shaped portion 6*d*, 6*s*.

The lower-leg-shaped portion 5*d*, 5*s* is connected to the end 4*a* of the portion 4*d*, 4*s* by a knee joint 7 and to the portion 6*d*, 6*s* by an ankle joint 8.

The knee joint 7 comprises a disk-shaped element 9 fixed to the end 5*a* of the portion 5*d*, 5*s*, and mounted for rotating about a pin 10 which is engaged in the end 4*a* of the thigh-shaped portion.

The disk-shaped element 9 is housed in a corresponding recess 11 formed in the end 4*a* of the thigh.

Inside each portion 4*d*, 4*s* there is a longitudinal housing 12 with a hole 13 facing towards the lower portion 14 of the torso 15 of the doll 1.

The housing 12 has a base 16 from which a hole 17 extends and opens in the vicinity of the recess 11.

A diaphragm 18 with an axial hole 19 is arranged transversely relative to the longitudinal axis of the housing 12 a predetermined distance from the base 16.

A rod-shaped element 20 is disposed in the housing 12 and in the hole 17 and a hooked end 21 thereof is connected to the disk 9 of the knee joint 7, engaging in a slot 22.

The connection is made at a point which is closer to the hollow 23 of the knee joint 7 than the pin 10.

The opposite end 24 of the element 20 is engaged for sliding in a recess 25 formed in the lower portion 14 of the dolls' torso 15.

A helical spring 26, arranged coaxially on the rod-shaped element 20, bears on the base 16 of the housing 12 at one end and its other end abuts a collar 27 fixed to the rod-shaped element 20.

It is clear from the foregoing that the maximum extension of the spring 26 is reached when the collar 27 abuts the diaphragm 18 of the housing 12.

The thigh-shaped portion 4*d*, 4*s* of each leg is connected to a respective support element 28*d*, 28*s* by snap-engagement between a pin 29 projecting from each element 28*d*, 28*s* and a hole 30 formed in each portion 4*d*, 4*s*.

Figure 4:
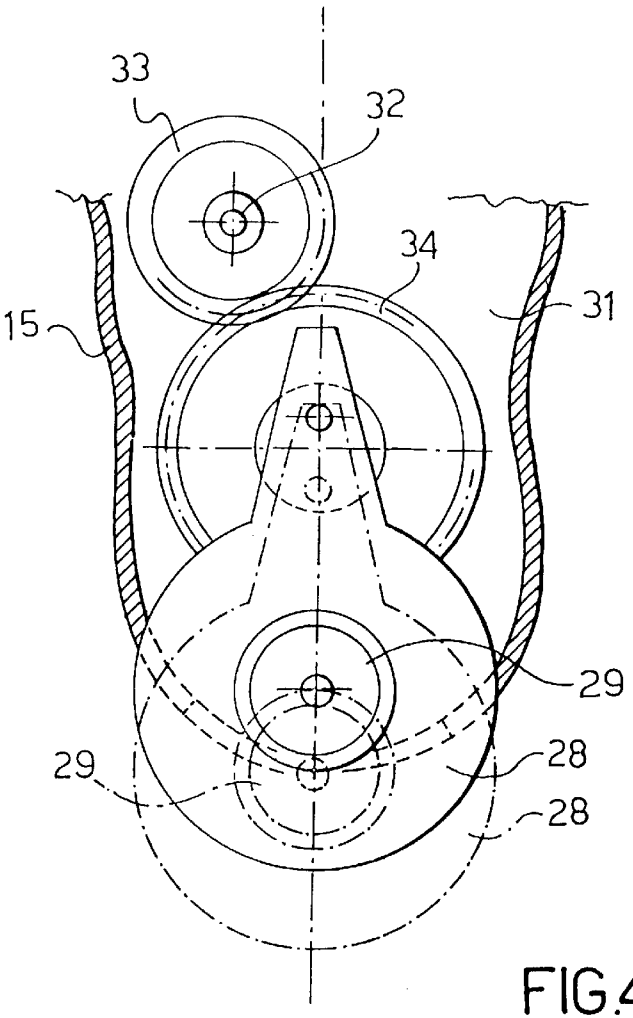
FIG. 4 is a schematic side view of the drive means for moving the thigh-shaped portion, in which the upper dead-point position which is adopted when the leg is extended as in FIG. 2 is shown in continuous outline, and the lower dead-point position is shown in broken outline.
Figure 5:
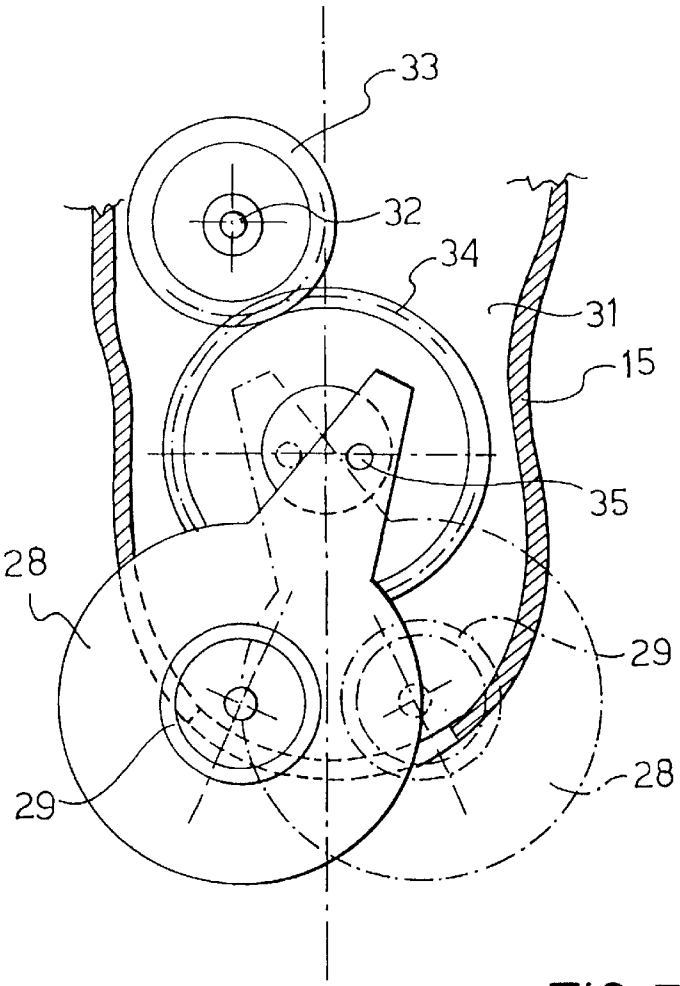
FIG. 5 is a schematic side view of the drive means for moving the thigh-shaped portions, in the intermediate positions which are adopted when the leg is bent during walking.

As shown in FIGS. 4 and 5, the support elements 28*d*, 28*s* constitute part of the drive means provided for moving the portions 4*d*, 4*s* of the legs.

This drive means is fitted, in known manner, in a compartment 31 in the doll's torso 15 and comprises a battery-operated electric motor, not shown, the shaft 32 of which transmits the rotary motion by means of a gear 33 to a second gear 34 which, as shown schematically, has, on its opposite faces, two eccentric pins 35*d*, 35*s* offset relative to one another by 180°.

The elements 28*d*, 28*s* which support the respective thigh-shaped portions 4*d* and 4*s* are connected to the pins 35*d* and 35*s*.

Figure 3:
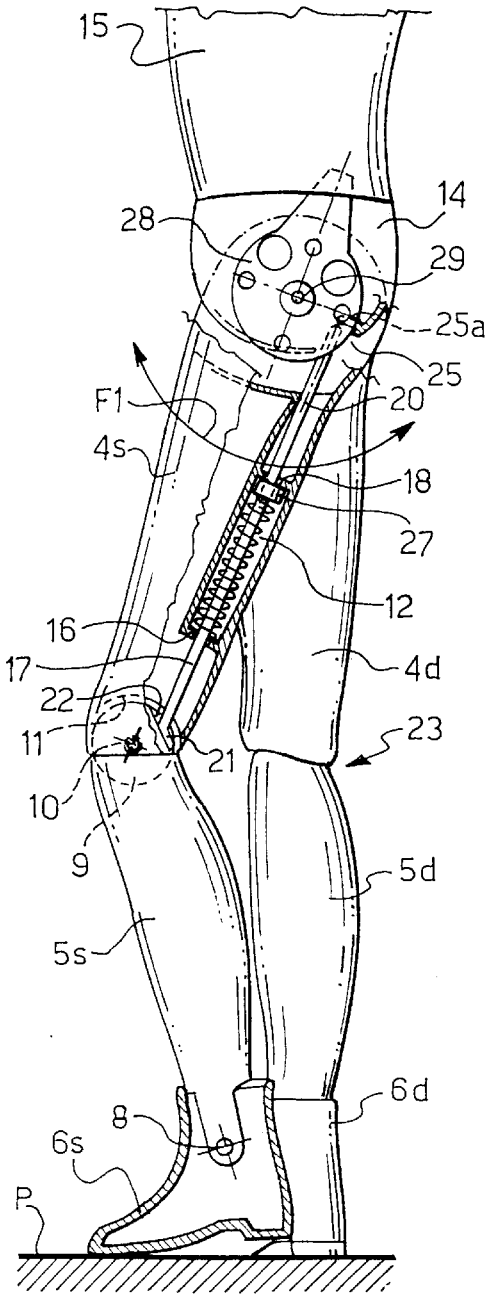
FIG. 3 is a side view similar to that of FIG. 2 with the leg in the bent position during walking.

The thigh-shaped portions 4*d* and 4*s* are therefore subject to respective pivoting movements in accordance with the arrow F1 of FIG. 3, out of phase with one another by 180°, in the vertical plane parallel to the direction in which the doll 1 is made to walk, and to respective rectilinear translational movements in the direction of the longitudinal axes of the thigh-shaped portions, between an upper dead-point position indicated in continuous outline in FIG. 4 and a lower dead-point position indicated in broken outline, also in FIG. 4.

Further details of the structure of the connection between the thigh-shaped portions 4*d*, 4*s* and the respective drive means are described in the document EP-A-0879626 cited in the introductory part of the present description.

The overall length selected for the rod-shaped element 20 is such that, when the leg is in the extended position with the support element 28*d* or 28*s* at the upper dead point, its free end 24, which is housed in the recess 25, is in abutment with a closed end 25*a* thereof.

Figure 2:
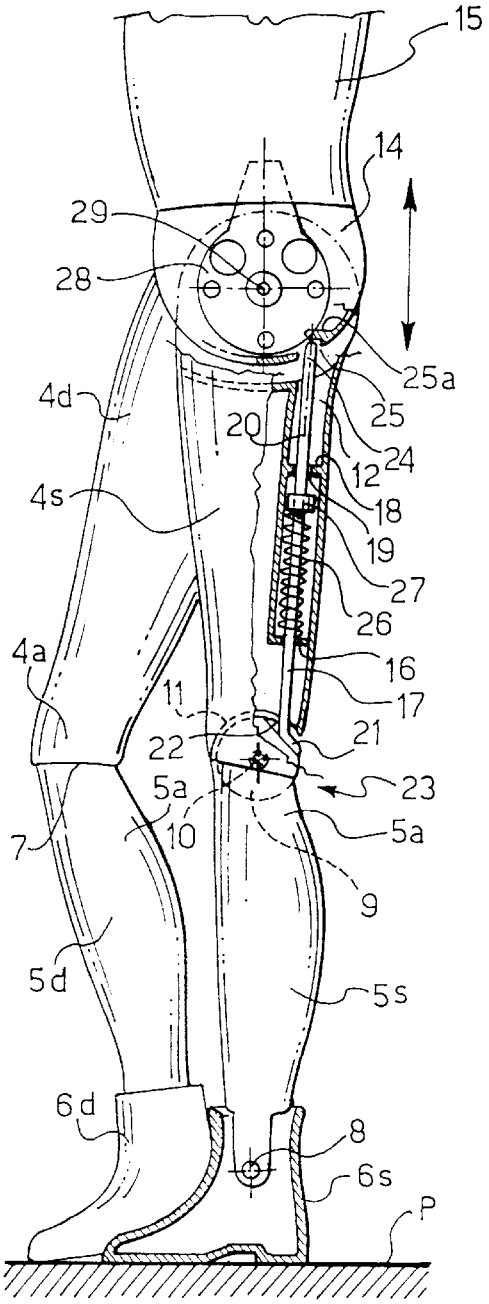
FIG. 2 is a side view of the lower portion of the doll with one leg shown in section, in the extended position.

In this position, the spring 26 is in the state of maximum compression and the collar 27 is spaced axially from the diaphragm 18 as shown in FIG. 2.

As a result of the angular movement of the portion 4*d* or 4*s* with the support element 28*d* or 28*s* moving towards the lower dead-point position, the rod-shaped element 20 of the respective leg, which is acted on by the spring 26 reacting against the base 16 of the guide housing 12, exerts a pull on the lower-leg-shaped portion 5*d* or 5*s*, causing it to bend as when taking a step.

At the same time, the foot-shaped portion 6*d* or 6*s* is raised and is free to pivot about the respective pin 8.

Figure 6:
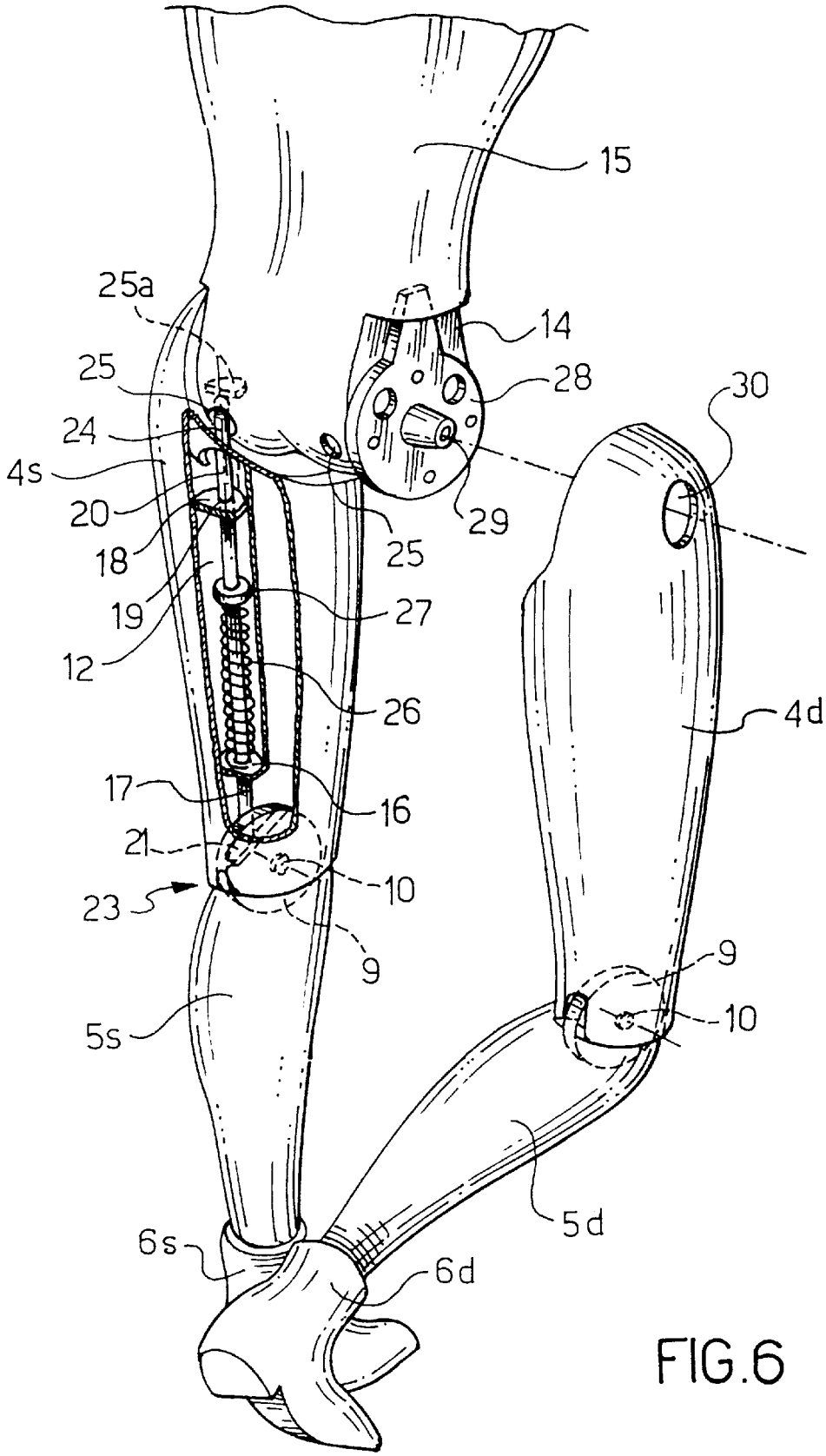
FIG. 6 is a simplified, schematic, partially exploded and partially sectioned view of the left-hand and right-hand thigh-shaped portions of the doll with the left leg in the extended position and the right leg in the bent position.
Figure 7:
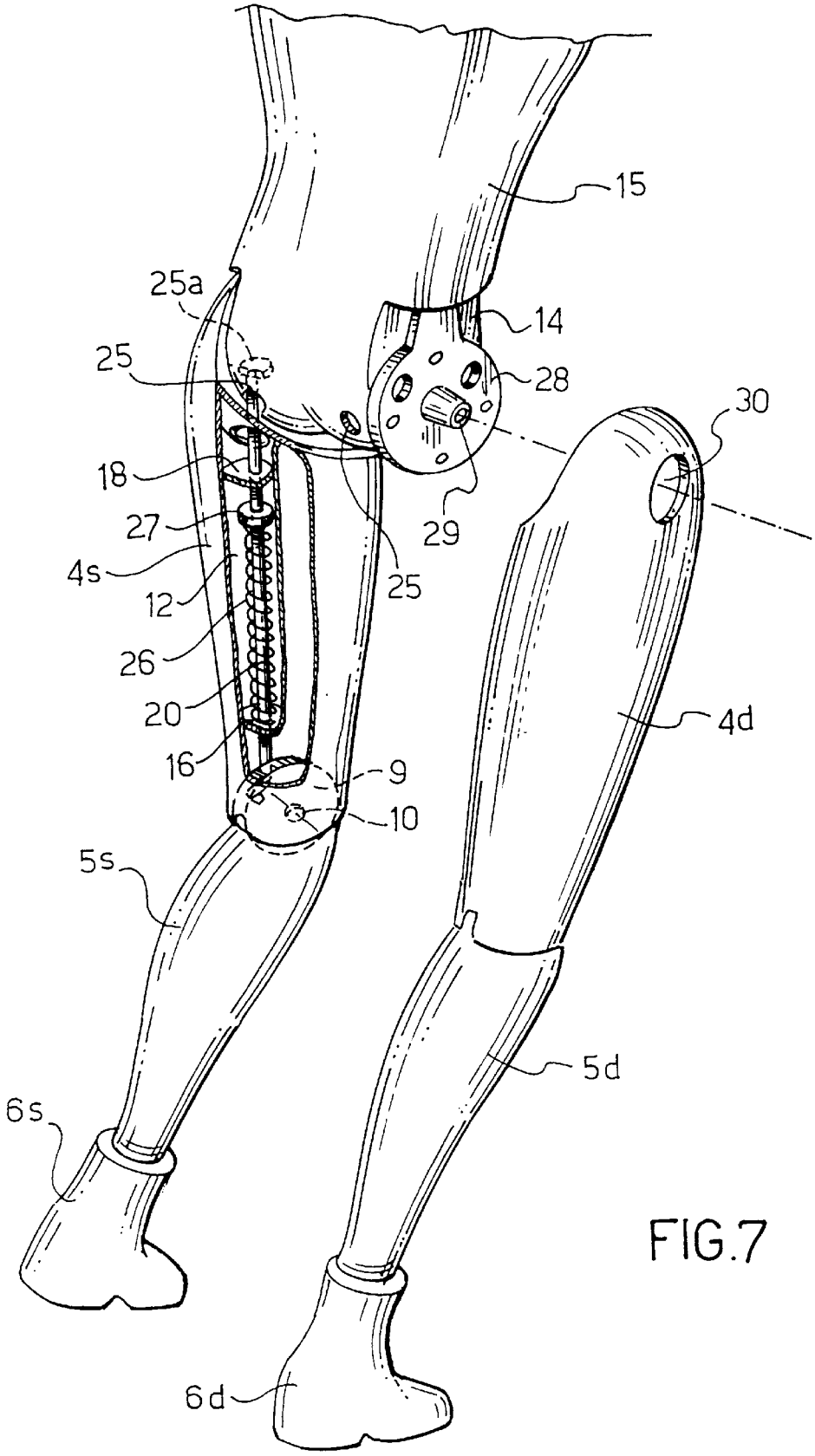
FIG. 7 is a view similar to that of FIG. 6 with both legs in a partially bent position.
Figure 8:
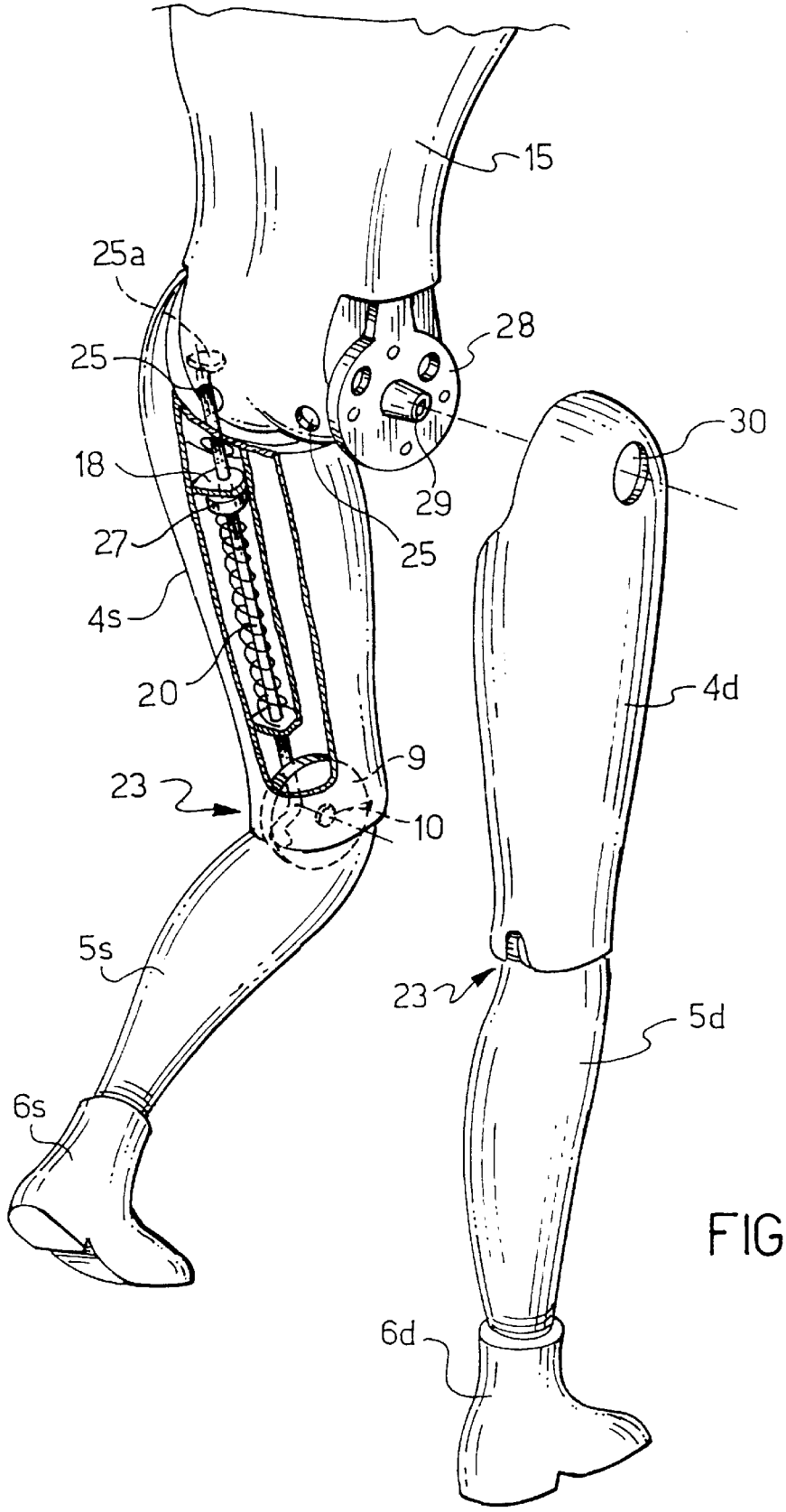
FIG. 8 is a view similar to those of FIGS. 6 and 7 with the left leg in the bent position which is adopted upon completion of the pivoting of the thigh-shaped portion when the drive means is in the lower dead-point position.
Figure 9:
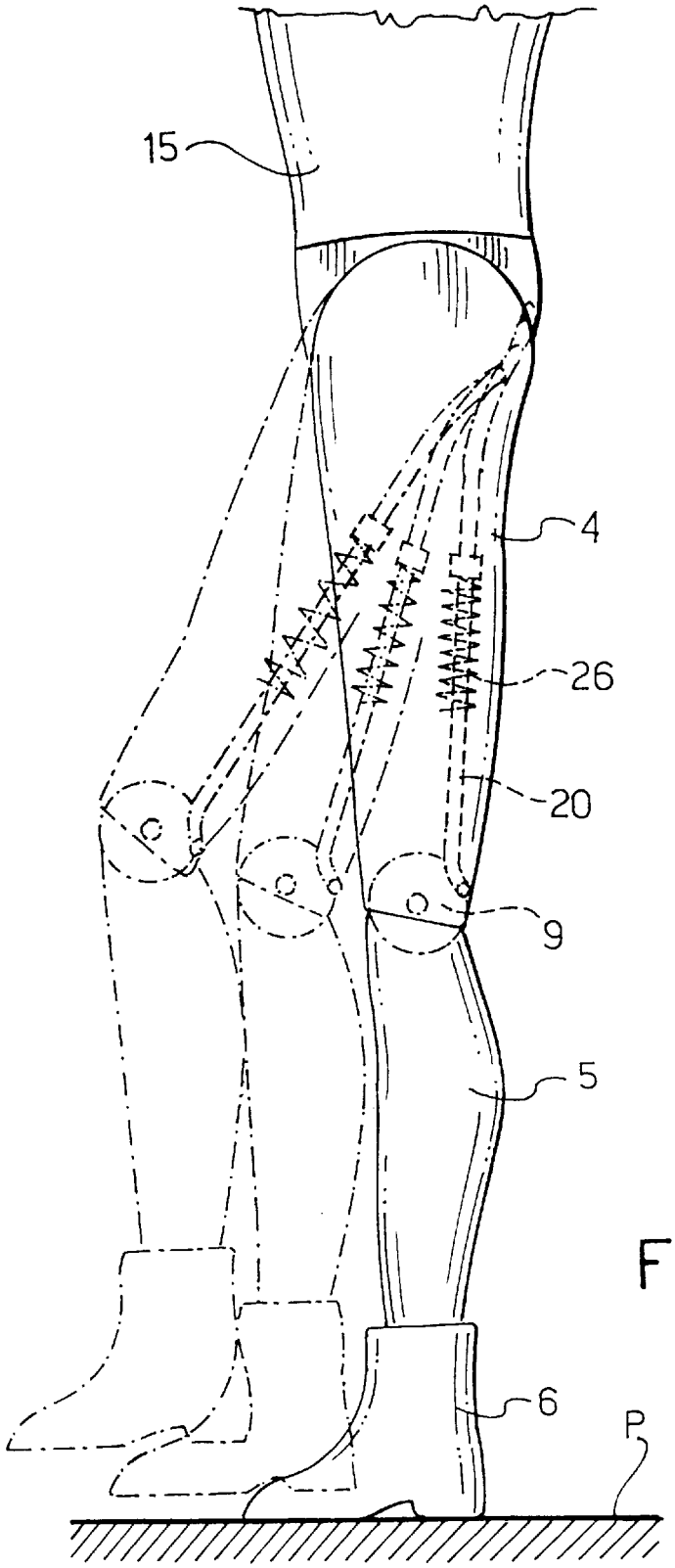
FIG. 9 is a side view of the lower portion of the doll, showing schematically the positions adopted by the rod-shaped element of the mechanism during the movement of the leg.

Upon completion of the angular movement in one direction with consequent raising and forward movement of the foot, the movement in the opposite direction causes the portion 6*d* or 6*s*, respectively, to bear on the support surface P and the leg to be straightened and to return to the position shown in section in FIG. 2 and, more schematically, also in FIG. 6.

Since the end 24 of the rod-shaped element is connected to the torso 15 of the doll purely so as to be slidable in the cavity 25 which extends linearly in accordance with the longitudinal axis of the end portion 24, it is also possible to bend the portion 4*d* or 4*s* of each leg at right angles to the torso 15 without causing damage to the mechanism for moving the legs.

The angular movement is made possible by the frictional connection between the hole 30 and the pin 29.

Figure 10:
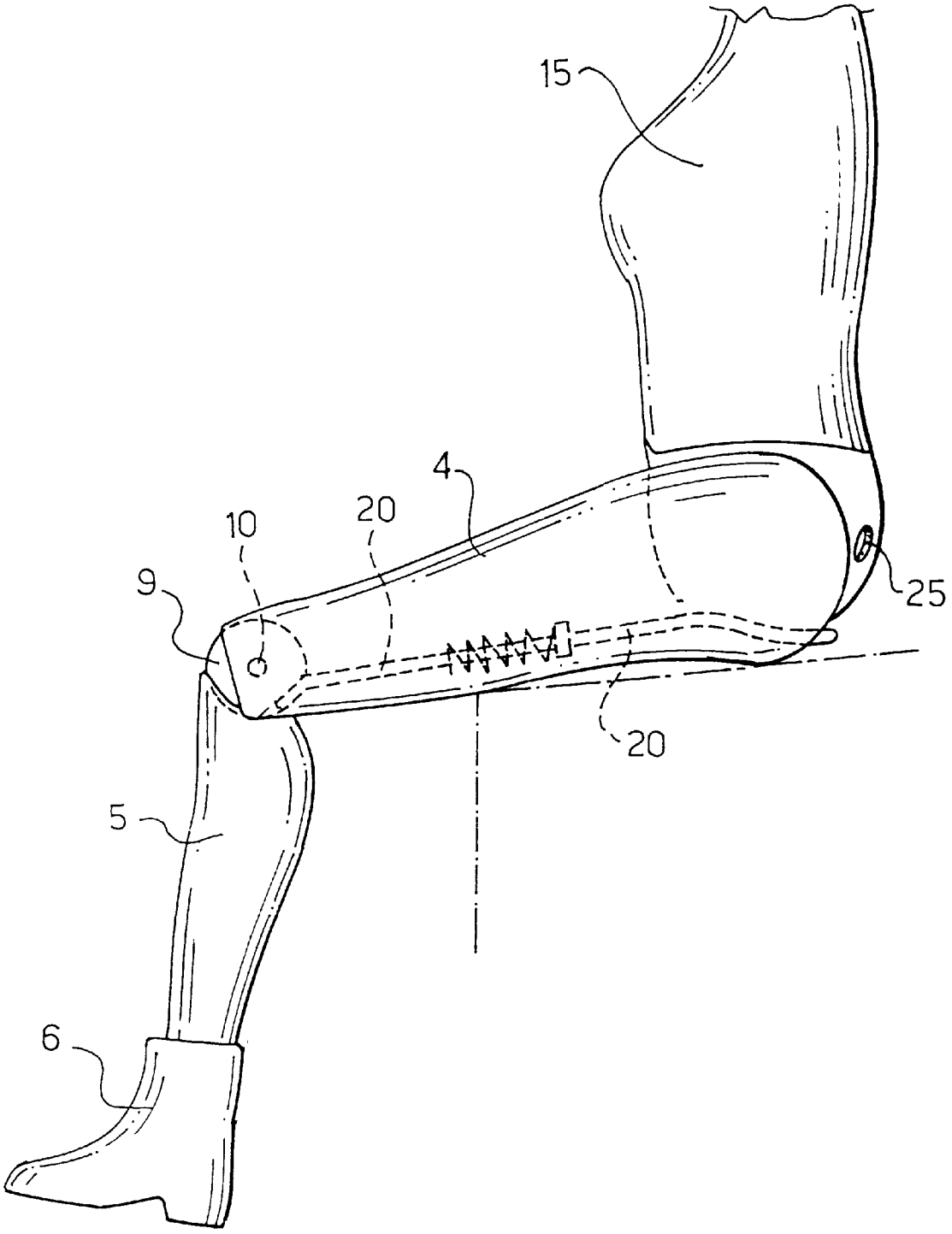
FIG. 10 is a side view of the doll in a sitting position with the thigh-shaped portion of one leg bent substantially at right angles to the torso.

The doll 1 can therefore adopt the sitting position at rest, as shown schematically in FIG. 10.

Although the end portion 24 of the rod-shaped element 20 can come out of the recess 25, the element 20 does not lose its operative positioning since it is restrained by the collar 27 in abutment with the diaphragm 18.

As soon as the legs are returned to the extended position, the end 24 of the rod-shaped element 20 is repositioned in the recess 25 and the mechanism is ready for subsequent operation.

What is claimed is:

1. A mechanism for moving a pair of lower limbs connected to a body of a toy figure in order to enable the toy figure to walk over a support surface in a manner similar to a human being, in which each of the limbs comprises a thigh-shaped portion, a lower-leg-shaped portion connected to an adjacent end of the thigh-shaped portion by a knee joint, and a foot-shaped portion connected to the lower-leg-shaped portion by an ankle joint, a drive means housed in a compartment of the body of the toy figure, said drive means being connected to the thigh-shaped portion for imparting thereto a pivoting movement in a vertical plane parallel to a direction in which the figure is made to walk, and means for imparting a rectilinear translational movement in a direction of a longitudinal axis of the thigh-shaped portion between a lower dead-point position and an upper dead-point position and vice versa, the translational movements of one of said pair limbs being out of phase by 180° with respect to the movements of the other of said pair of limbs, means for counterbalancing a reaction torque generated by the drive means during the movement of the thigh-shaped portion, a rod-shaped element extending along the thigh-shaped portion, said rod-shaped element having one end connected to a point on the said lower-leg-shaped portion situated at a back of the knee joint and relative to an axis of the knee joint, said rod-shaped element having the opposite end sliding freely in a recess with a closed end formed in the body of the toy figure, and a resilient member fitted between a point along a length of the rod-shaped element and a point fixed relative to the thigh-shaped portion, said resilient member acting on the rod-shaped element to urge the opposite end towards the closed end of the recess.

2. A mechanism according to claim 1, wherein the rod-shaped element is disposed inside the thigh-shaped portion in a housing which constitutes a longitudinal sliding guide.

3. A mechanism according to claim 1, wherein said resilient member is a helical spring arranged coaxially on the rod-shaped element, said spring reacting between a collar fixed to the rod-shaped element and a shoulder fixed on the thigh-shaped portion.

4. A mechanism according to claim 1, wherein said recess with the closed end formed in the body of the toy figure extends linearly relative to the longitudinal axis of the end portion of said rod-shaped element.

5. A mechanism according to claim 1, wherein said rod-shaped element has a length such that, when the thigh-shaped portion is in the upper dead-point position, the opposite end of said rod-shaped element sliding in said recess of the body of the toy figure is in abutment with the end thereof, and said resilient member has a length which is in maximum compression at said upper dead-point position.

6. A mechanism according to claim 3, wherein said recess comprises a housing with a disk having a central hole through which the rod-shaped element slides, the disk constituting an abutment for engaging said collar on the rod-shaped element for retaining said rod within the housing responsive to an extension of said helical spring.

* * * * *

UNITED STATES PATENT AND TRADEMARK OFFICE

CERTIFICATE OF CORRECTION

PATENT NO. : 6,120,343
DATED : September 19, 2000
INVENTOR(S) : Sostene Migliorati It is certified that error appears in the above-identified patent and that said Letters Patent is hereby corrected as shown below:

Title Page,

[73] Assignee: insert --Giochi Preziosi Lussemburgo SA, Luxembourg, Luxembourg--

[30] Foreign Application Priority Data
insert --April 12, 1998 (EP) European....98204123.8--

Signed and Sealed this

Fifteenth Day of May, 2001

Nicholas P. Godici

*Attest:*

NICHOLAS P. GODICI

*Attesting Officer*

*Acting Director of the United States Patent and Trademark Office*